US012607439B2

(12) United States Patent
Rycroft et al.

(10) Patent No.: US 12,607,439 B2
(45) Date of Patent: Apr. 21, 2026

(54) BLAST SHIELD APPARATUS AND METHOD

(71) Applicant: United States of America as Represented by The Secretary of The Army, Alexandria, VA (US)

(72) Inventors: Taylor Rycroft, Sherborn, MA (US); Griffin Donohue, Guilford, CT (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 98 days.

(21) Appl. No.: 18/797,095

(22) Filed: Aug. 7, 2024

(65) Prior Publication Data

US 2026/0063409 A1 Mar. 5, 2026

(51) Int. Cl.
*F42D 5/05* (2006.01)

(52) U.S. Cl.
CPC ..... *F42D 5/05* (2013.01)

(58) Field of Classification Search
CPC ... F42D 5/04; F42D 5/045; F42D 5/05; F42B 39/14
See application file for complete search history.

(56) References Cited

U.S. PATENT DOCUMENTS

| | | | | |
|---|---|---|---|---|
| 770,078 | A * | 9/1904 | Krüger | B63B 43/16 114/229 |
| 3,648,613 | A * | 3/1972 | Cunn | F42D 5/05 102/303 |
| 5,685,252 | A * | 11/1997 | Prysner | B63B 43/16 114/229 |
| 11,060,833 | B2 * | 7/2021 | Nzengung | F42D 5/05 |
| 11,585,647 | B2 * | 2/2023 | Fitzgerald | F42D 5/05 |
| 12,038,266 | B2 * | 7/2024 | Nzengung | F42D 5/05 |
| 12,490,845 | B2 * | 12/2025 | Shah | A47G 9/0223 |
| 2010/0282050 | A1 * | 11/2010 | Peers-Smith | F42D 5/05 102/303 |
| 2014/0317844 | A1 * | 10/2014 | Jacobsen | A47G 9/0223 5/482 |
| 2016/0040962 | A1 * | 2/2016 | Rossow | B32B 5/06 89/36.02 |
| 2017/0253348 | A1 * | 9/2017 | Ashdown | H04K 3/68 |
| 2018/0112963 | A1 * | 4/2018 | Nzengung | F42D 5/05 |
| 2018/0335779 | A1 * | 11/2018 | Fisher | F41H 13/0006 |
| 2021/0364267 | A1 * | 11/2021 | Nzengung | F42D 5/05 |
| 2024/0369337 | A1 * | 11/2024 | Nzengung | F42D 5/05 |

* cited by examiner

*Primary Examiner* — Benjamin P Lee
(74) *Attorney, Agent, or Firm* — Brian C. Jones

(57) ABSTRACT

In one embodiment, a blast shield apparatus comprises: a blast resistant blanket having a blanket edge and a blanket center region; a plurality of blanket magnets disposed near the blanket edge and distributed along the blanket edge; and a chamber having a first side facing the blast resistant blanket and coupled to the blanket center region of the blast resistant blanket, and a second side opposite from the first side and facing away from the blast resistant blanket. The chamber includes a chamber interior to store a gas.

20 Claims, 6 Drawing Sheets

BLAST SHIELD APPARATUS AND METHOD

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to systems and methods of mitigating blast pressure and containing detonation byproducts of an explosion and, more specifically, an underwater explosion.

Description of the Related Art

This section introduces aspects that may help facilitate a better understanding of the invention. Accordingly, the statements of this section are to be read in this light and are not to be understood as admissions about what is prior art or what is not prior art.

Unexploded munitions in underwater environments pose an explosive safety risk from encounters by the recreating public (e.g., divers), marine industries (e.g., fishing, telecommunications), and other commercial enterprises (e.g., dredging, drilling) that may make incidental contact and cause unintentional detonation. Manual retrieval of underwater unexploded ordnance (UXO) targets is a costly endeavor that puts divers at risk. Some underwater targets cannot be moved due to explosive safety concerns and require blow-in-place (BIP) operations that can adversely affect marine life as well as threaten man-made infrastructure and cause logistical issues with closure of sections of water passages due to considerable required standoff distances for vulnerable/susceptible assets.

While in-situ detonation reduces risk to diver safety, the tradeoff is that it poses higher risk to infrastructure (near-onshore, above-water, floating, underwater, and buried subsediment), underwater historical artifacts, and the proximal marine ecosystem (biotic and abiotic) that are affected by the blast pressure waves and acoustics. These stressors, while mechanically similar to the shock front of an aboveground detonation, can be an order of magnitude greater underwater than a detonation of the same explosive weight in open-air. Additionally, blast impact correlates directly with distance between source and target, source depth, and sea bottom composition.

Non-explosive neutralization techniques are appealing alternatives in concept, but options such as freezing, autonomous underwater vehicles for recovery, jet cutting, and entombment are unproven, may result in accidental detonation, may be prohibitively expensive, or may introduce unintended environmental threats. A common technological solution for underwater explosion (UNDEX) management is the bubble curtain (single, double, and triple), which has demonstrated efficacy with smaller charges but is unproven at larger explosive weights.

U.S. Pat. No. 11,060,833 discloses anchoring edges of a munition and ordnance remediation blanket to the seafloor or ground around the explosive and using neutralization reagents to neutralize bulk explosives and destroy residual explosives.

SUMMARY

The present invention was developed to address the desire for cost-effective technologies to address human and environmental health and safety concerns when remediating munitions, especially in the underwater setting. An encapsulating blast shield blanket is designed to mitigate blast pressure and contain detonation byproducts including, for instance, detonation byproducts resulting from BIP of underwater UXO. The result is a cost-effective, safe, and environmentally acceptable technique for remediating military munitions found at underwater sites that cannot be moved due to explosive safety concerns and where BIP underwater operations can significantly affect the surrounding environment. The blast shield blanket is useful to any military or commercial entity which is interested in an underwater blast shield that can reduce/contain blast pressure, impulse, and byproducts.

Embodiments of the invention are directed to a blast shield method. The blast shield blanket is affixed to a deflated air chamber or bladder. The ordnance-facing surface of the air bladder is distressed/pre-ripped to ensure it is destroyed during the explosion and that the explosion can partially occur in air before it contacts the blanket and moves towards the air in the air bladder (following the path of least resistance) and pushes the blanket upward (toward the water surface), so that it rises in the desired manner to ensure the magnets near the edge of the blanket come in contact with each other. This design allows for dissipation of energy at the explosion source, impedance of the shock front, and redirection of the explosion energy.

In accordance with an aspect of the invention, a blast shield apparatus comprises: a blast resistant blanket having a blanket edge and a blanket center region; a plurality of blanket magnets disposed near the blanket edge and distributed along the blanket edge; and a chamber having a first side facing the blast resistant blanket and coupled to the blanket center region of the blast resistant blanket, and a second side opposite from the first side and facing away from the blast resistant blanket. The chamber includes a chamber interior to store a gas.

Another aspect of the invention is directed to a blast shield method which includes placing a blast shield apparatus on top of an explosive device. The blast shield apparatus includes a blast resistant blanket having a blanket edge and a blanket center region. A plurality of blanket magnets are disposed near the blanket edge and distributed along the blanket edge. A chamber has a first side facing the blast resistant blanket and coupled to the blanket center region of the blast resistant blanket. A second side opposite from the first side and facing away from the blast resistant blanket and toward the explosive device. The second side is disposed on top of the explosive device. The chamber is filled with a gas. The explosive device is detonated, which may be done in-situ.

According to yet another aspect of the invention, a blast shield apparatus comprises: a blast resistant blanket having a blanket edge and a blanket center region; a plurality of blanket magnets disposed near the blanket edge and distributed along the blanket edge; a chamber having a first side facing the blast resistant blanket and coupled to the blanket center region of the blast resistant blanket, and a second side opposite from the first side and facing away from the blast resistant blanket, the chamber including a chamber interior to store a gas; and a mechanism or means for, after an explosion causes a bubble created by an expansion of the gas in the chamber to collapse and the blast resistant blanket to rise in the blanket center region relative to the blanket edge, to close the blast resistant blanket at the blanket edge to encapsulate explosion debris and byproducts of the explosion.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

One feature of this invention is to provide a cost-effective, safe, and environmentally acceptable remediation technique for underwater unexploded ordnance (UXO) by way of a multi-layered, virtually indestructible blast blanket integrated with a sacrificial air compartment and remotely activated magnets. When subjected to an intentionally detonated UXO directly beneath it during a blow-in-place (BIP) operation, the blast shield blanket will reduce the peak shock load and impulse of the blast along with the propagation of energy in the surrounding medium (e.g., secondary pulses resulting from repeated gas bubble formation and cavitation), sequester/encapsulate the explosion byproducts (e.g., shrapnel, chemical constituents, etc.), and be retrievable post-detonation for simple disposal of all captured remnants of the ordnance. This approach will reduce BIP blast impacts to man-made and natural structures, as well as marine life in the vicinity of the detonation.

Figure 1:
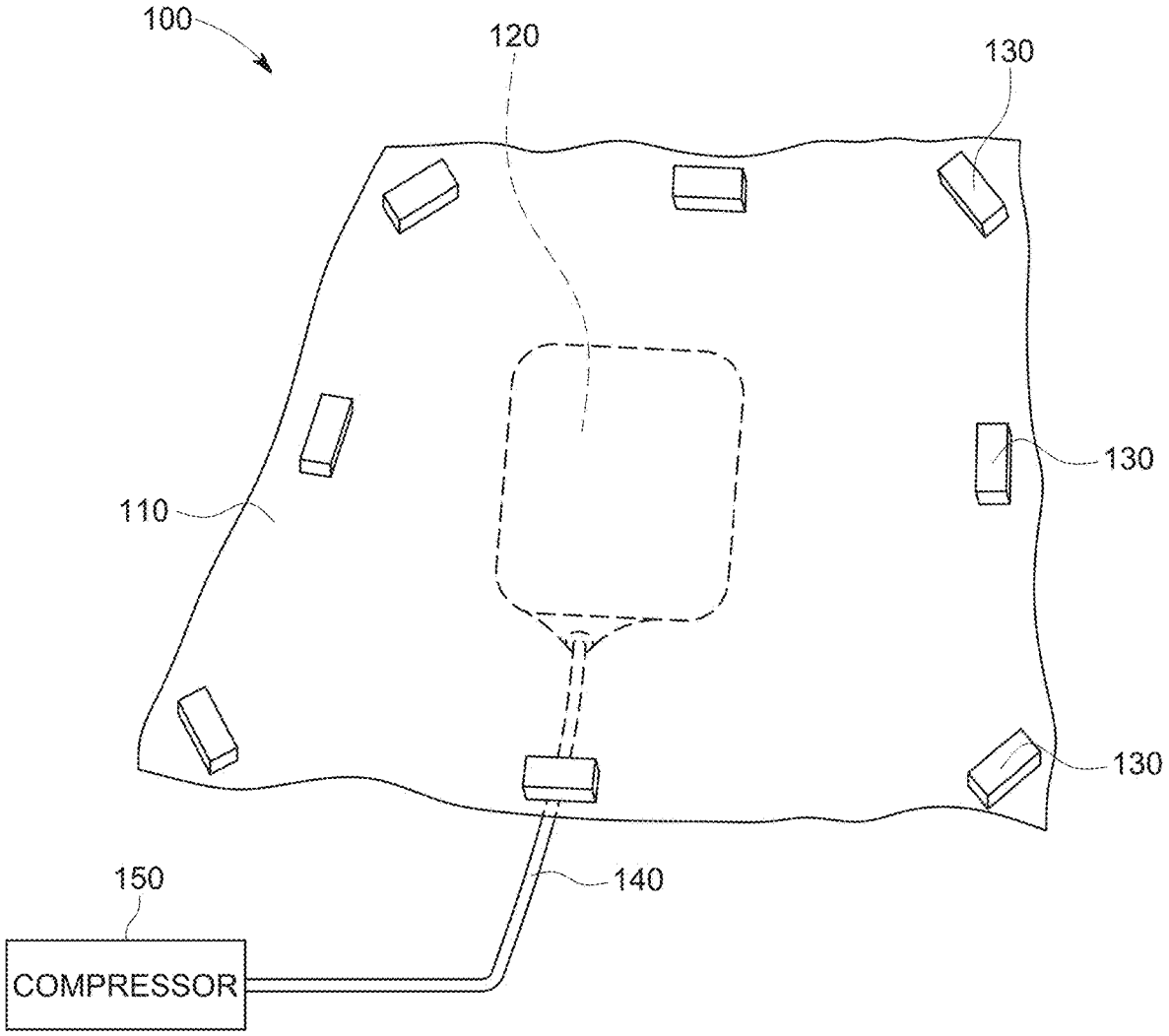
FIG. 1 is a schematic view illustrating an example of a blast shield apparatus configured to be placed on top of an explosive.

FIG. 1 is a schematic view illustrating an example of a blast shield apparatus 100 configured to be placed on top of an explosive such as an UXO. The apparatus includes a blast shield blanket or bomb-proof blanket 110 and an air/gas chamber 120. A plurality of peripheral magnets 130 are disposed around the periphery of the blanket 110. An air/gas hose 140 is connected between an air/gas inlet of the air/gas chamber 120 and an air pump/compressor 150.

The blast shield blanket 110 may be square or rectangular as shown, or have any other suitable shape, such as circular, elliptical, polygonal, etc. The shape of the explosive may be used to design the shape of the blanket. The size and the explosive power (e.g., estimated blast radius) of the explosive may be used to design the size of the blanket. Modeling and simulation and/or experimentation may be used to develop suitable or optimal blanket sizes and shapes. A larger blanket is more suitable for containing a larger explosive size and/or a larger explosive power.

Figure 2:
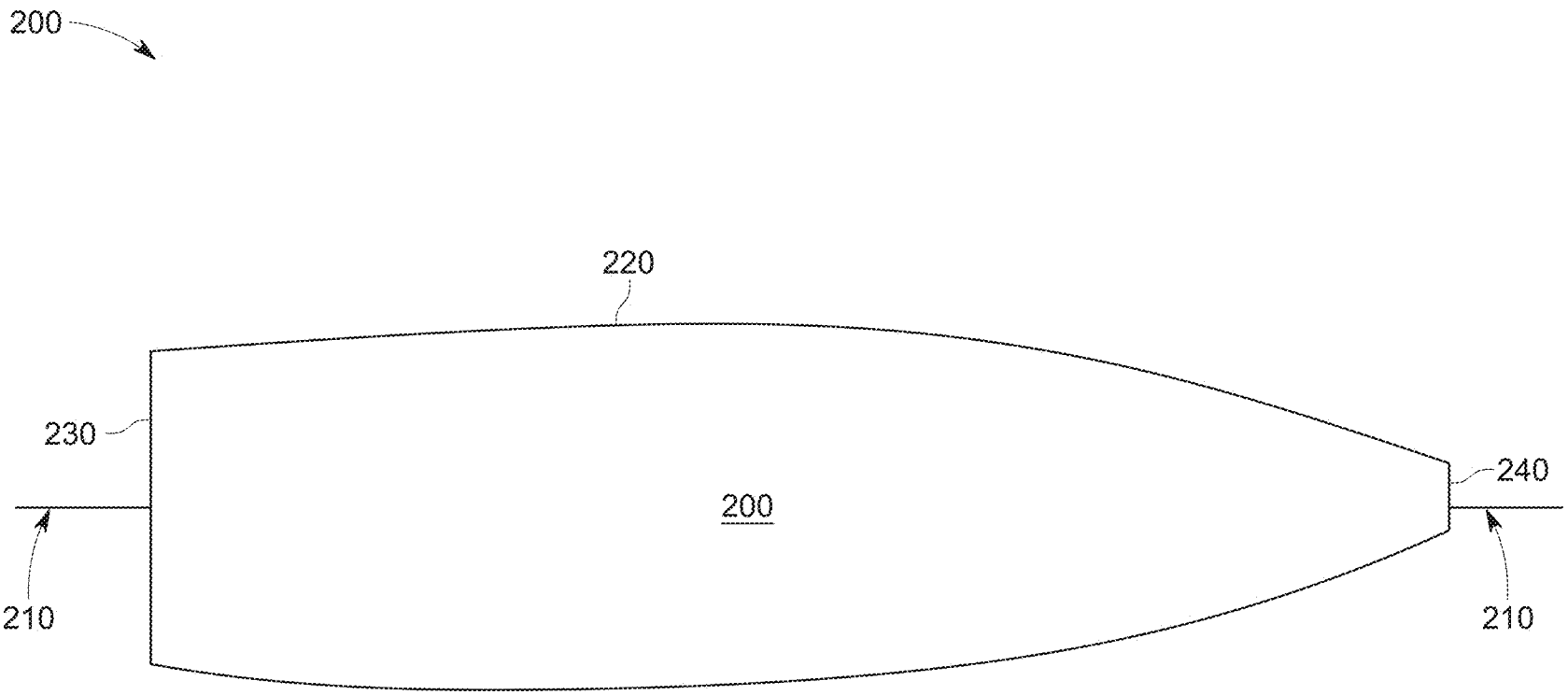
FIG. 2 is a schematic view of an explosive device partially buried in the seafloor or ground.

FIG. 2 is a schematic view of an explosive device 200 partially buried in the seafloor or ground 210. In general, the surface area of the blanket (top surface or bottom surface) is one to three orders of magnitude larger than (i.e., 10-1,000 times) the surface area of the explosive device, more specifically, the upper surface area or exposed surface area of the explosive device. For example, the surface area of the blanket is about 100 times (±10%) the surface area of the upper surface of the explosive device which is oriented generally upward (i.e., upper surface 220) instead of downward, or, about 100 times (±10%) the surface area of the exposed surface of the explosive device which is exposed (i.e., exposed surfaces 220, 230, 240) instead of being buried or covered by the floor 210 on which it is disposed.

The blanket magnets 130 may be inducible electromagnets affixed to the blanket 110 near the blanket edge, which are switchable between an inactivated state and an activated state. The number, size, and spacing of the blanket magnets 130 may vary between different embodiments, and may depend on the size and shape of the blanket 110 and/or the size and shape of the chamber 120. In the embodiment shown, four magnets 130 are disposed near four corners of the rectangular blanket 110 and four magnets 130 are disposed between adjacent corners, respectively, of the rectangular blanket 110. The blanket 110 may have other shapes including circular or elliptical.

The blast shield apparatus 100 has a variety of applications. For example, it is an innovative solution to safely and effectively manage underwater unexploded ordnance (UXO) that must be blown-in-place (BIP). It is designed to attenuate the explosive force of the UXO when detonated during BIP operations, contain the explosion byproducts, and ensure easy retrieval of all ordnance remnants. In embodiments, a multi-layered, flexible, bomb-proof blanket 110 is affixed to a self-sacrificing air chamber 120 and lined peripherally with on/off controllable electromagnets 130. Upon detonation of the UXO beneath the blast shield apparatus 100, the apparatus reduces both the early-time shock pressures of the blast and the late-time bubble jetting due to the collapse of the bubble created by the expansion of gases and the energy released by the explosive. The blast shield blanket 110

"wraps around" the explosion as it rises in the water column and encapsulates all debris and byproducts or substantially all debris and byproducts. At the termination of the explosion reaction, the blanket 110, containing preferably all ordnance remnants, sinks to the seafloor where it can be retrieved easily with an electromagnet lowered by a cable from the water surface. The apparatus can be easily customized/modified to accommodate UXO of different sizes and shapes by adjusting the size and shape of the blanket 110 and air chamber 120.

The magnets 130 may be evenly or substantially evenly distributed (e.g., ±20%, ±10%, or ±5%) in terms of spacing between adjacent magnets 130. The spacing should not be too small so as to cause the magnets to adhere to each other prematurely before the detonation has progressed far enough along to allow the bubble created by the expansion of the gas in the chamber 120 to collapse, the blanket 110 to rise in the blanket center region, and the edge of the blanket 110 to encapsulate the explosion byproducts. The spacing should not be too large such that the blanket magnets 130 are too slow to adhere to each other to close the blanket and allow explosion byproducts to escape encapsulation by the blanket 110. The size of the blanket 110 and the size and/or power of the explosive are factors to consider. Modeling and simulation and/or experimentation may be used to develop suitable or optimal magnet spacings. In general, there are at least four blanket magnets for a small blanket, or at least eight blanket magnets for a medium blanket, or at least twelve blanket magnets for a large blanket, distributed around the periphery of the blanket 110.

The bomb-proof blanket 110 may be made from a material similar to Kevlar® having extremely strong aramid fibers or the like for the containment of fragmentary and shrapnel ejection. An outer layer of the blanket may be made of an impermeable plastic or fiber. The blanket may further include one or more neutralization reagents to be released and rapidly react with explosive fillers of munitions. The blanket is flexible so that it can "wrap around" the explosion as it rises in the water column, and is virtually indestructible so that the explosion does not rupture the blanket and escape encapsulation. An example of a high-strength, flexible ballistic material is aramid. In sum, the bomb-proof blanket 110 is designed with mechanical, thermal, and chemical properties to withstand the force and heat energy of the explosion as well as punctures from high-velocity shrapnel and degradation from chemical constituents.

The air chamber 120 resembles a collapsible air or liquid storage bladder. It is made from a thin, flexible film that will rupture/fail when exposed to explosive forces, high heat, or shrapnel punctures. Suitable materials for the air chamber include polymers such as polyethylene (PE), polystyrene (PS), polyamides (nylon), poly(vinyl chloride) (PVC), and synthetic rubber. On its top side or first side, the air chamber 120 may be affixed (e.g., sewn or glued) to the blanket 110 and on its bottom-side or second side (the side touching the UXO) it is distressed or pre-ripped/punctured to ensure that it is destroyed immediately at the initiation of the detonation reaction.

The air chamber 120 is disposed in a center region of the blanket 110. It helps ensure that the detonation of the explosive and rupture of the air chamber 120 will cause the center of the blanket 110 to rise and the edge of the blanket to be generally spaced around the detonation and encapsulate the explosion debris and byproducts of the detonated explosive device. Otherwise, the blanket may rise in an off-balanced manner and allow the explosion debris and byproducts to escape capture toward a side of the blanket that rises higher and faster than the rest of the blanket.

Figure 3:
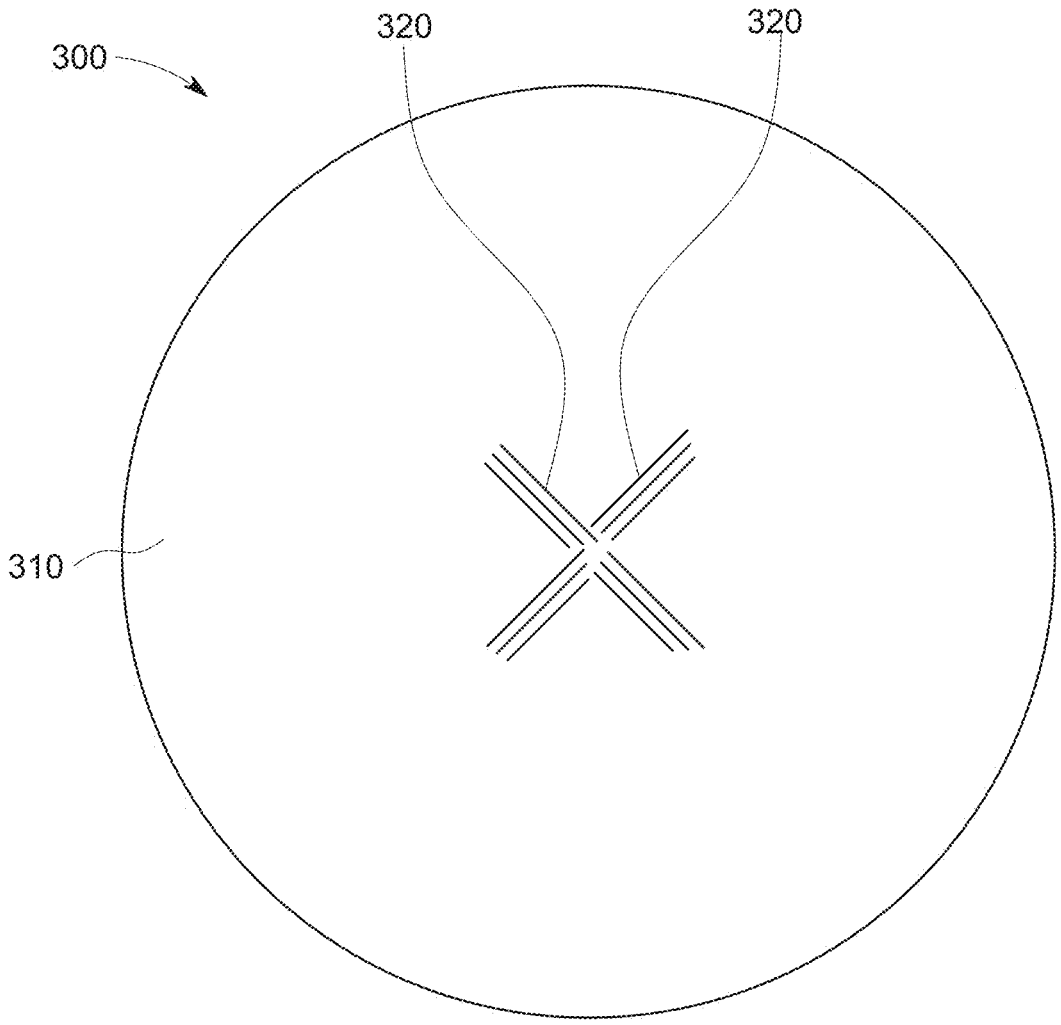
FIG. 3 shows an example of a bottom side of the air chamber having slits that weaken the bottom side for rupture or failure.

FIG. 3 shows an example of a bottom side or second side 310 of a circular disk shaped or saucer shaped air chamber 300 having cuts or slits 320 that weaken the bottom side 310 for rupture or failure. The slits 320 may be through slits through the thickness of the bottom side 310 or partially through slits or a combination thereof. The shape of the explosive device may be used to design the shape of the air chamber 300. For example, when filled, the air chamber may be circular cylindrical, disk, or flying saucer in shape. The size and the explosive power of the explosive may be used to design the size/volume of the air chamber. Modeling and simulation and/or experimentation may be used to develop suitable or optimal air chamber sizes and shapes. A larger air chamber is more suitable for a larger explosive size and/or a larger explosive power. The bottom surface area or second side surface area of the air chamber 120 facing the explosive is larger than the upper surface area or exposed surface area of the explosive device. For example, the bottom surface area of the air chamber 120 is one to two orders of magnitude larger (i.e., 10-100 times) than the surface area of the upper surface of the explosive device, which is oriented generally upward instead of downward, or of the surface area of the exposed surface of the explosive device which is exposed instead of being buried or covered by the floor on which it is disposed. As such, the surface area of the blanket (top surface or bottom surface) may be one to two orders of magnitude larger than (i.e., 10-100 times) the top surface area (first side surface area) or bottom surface area (second side surface area) of the air chamber 120.

The air within the bladder 120 serves at least two purposes: (1) it offers the explosion reaction an area of least resistance in which to initiate and encourages the blast bubble to stay in the center of the blanket 110 rather than migrating toward an edge and potentially escaping encapsulation, and (2) it significantly reduces the initial shock front from the blast because explosive stress is an order of magnitude less in air than in water. During transport and placement of the blast shield apparatus 100 around the UXO, the air bladder 120 is deflated. It is inflated using an air hose 140 connected to an air pump/compressor 150 at the surface just prior to BIP detonation. The chamber 120 is not limited to air. It may be filled with a suitable gas or gas mixture of a variety of gas components including, for example, one or more of nitrogen, oxygen, argon, hydrogen, carbon dioxide, helium, etc.

The blanket magnets 130 may be remotely activated electromagnets that can be turned on or off using a power cord tethered to the explosive or wireless means such as an RF signal or an acoustic signal. They are affixed (e.g., sewn in) to the blanket 110 near the edge of the blanket. For example, the magnets 130 may be attached at the blanket edge or may be spaced from the blanket edge by a distance no larger than a width of the magnet 130 oriented parallel to the blanket surface, where the width is a smaller dimension than a length of the magnet also oriented parallel to the blanket surface. The magnets 130 are spaced from each other such that when the center of the blanket 110 rises and the blanket magnets 130 along the edge of the blanket are pulled closer together, the blanket magnets 130 will adhere to one another. The blanket magnets 130 are turned off during transport and placement of the apparatus 100 around the UXO and turned on just before the BIP detonation.

In operation, the blast shield blanket 110 is affixed to a deflated air chamber 120 similar to an air bladder. The ordnance-facing surface or second side 310 of the air bladder 120 is distressed/pre-ripped to ensure it is destroyed during the explosion and that the explosion can 1) partially occur in air before it contacts the blanket 110, and 2) moves towards the air in the air bladder and pushes the blanket upward, so that it rises in the desired manner to ensure the magnets 130 near the edge of the blanket 110 come in contact with each other. This design allows for dissipation of energy at the explosion source, impedance of the shock front, and redirection of the explosion energy.

Figure 4:
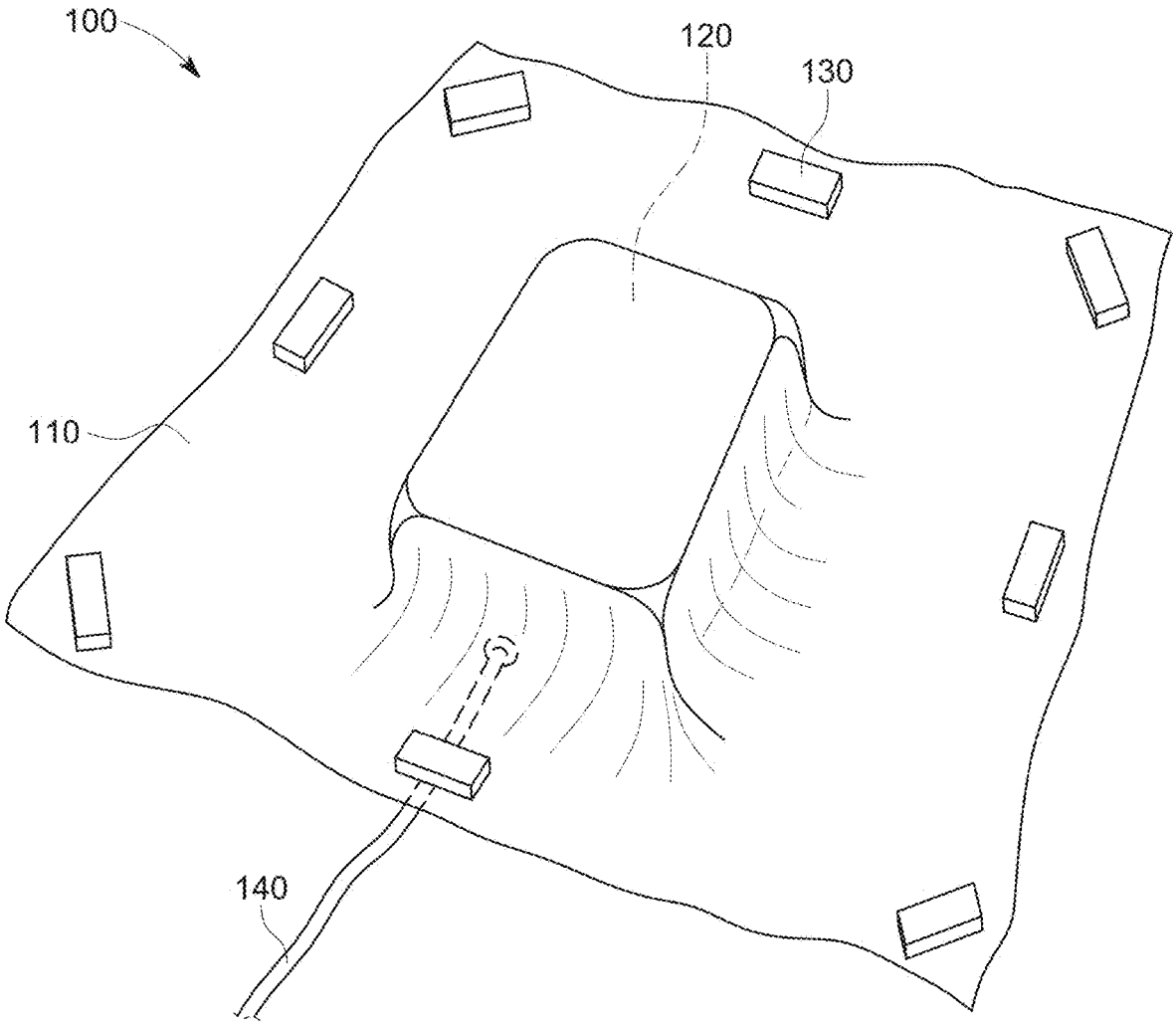
FIG. 4 is a schematic view illustrating initial movement of the blast shield apparatus in response to detonation of the explosive.

FIG. 4 is a schematic view illustrating initial movement of the blast shield apparatus 100 as it lays atop the UXO and the air bladder 120 is filled, or in immediate response to detonation of the explosive. Just prior to the BIP detonation, the air bladder 120 is filled with air using a hose 140 connected to an air pump/compressor at the surface of the waterbody and the edge electromagnets 130 are turned on.

Upon detonation, the air bladder 120 ruptures, exposing the explosive energy to a large volume of air (rather than water). Energy from the explosion is released in this air space and the center of the blanket 110 is forced upward toward the water surface. The magnets 130 each have a sufficient weight to drop in elevation relative to the rising center of the blanket 110. As the center of the blanket 110 rises, the attached magnets 130 near the edge of the blanket are pulled closer together until they are close enough to adhere to one another.

Figure 5:
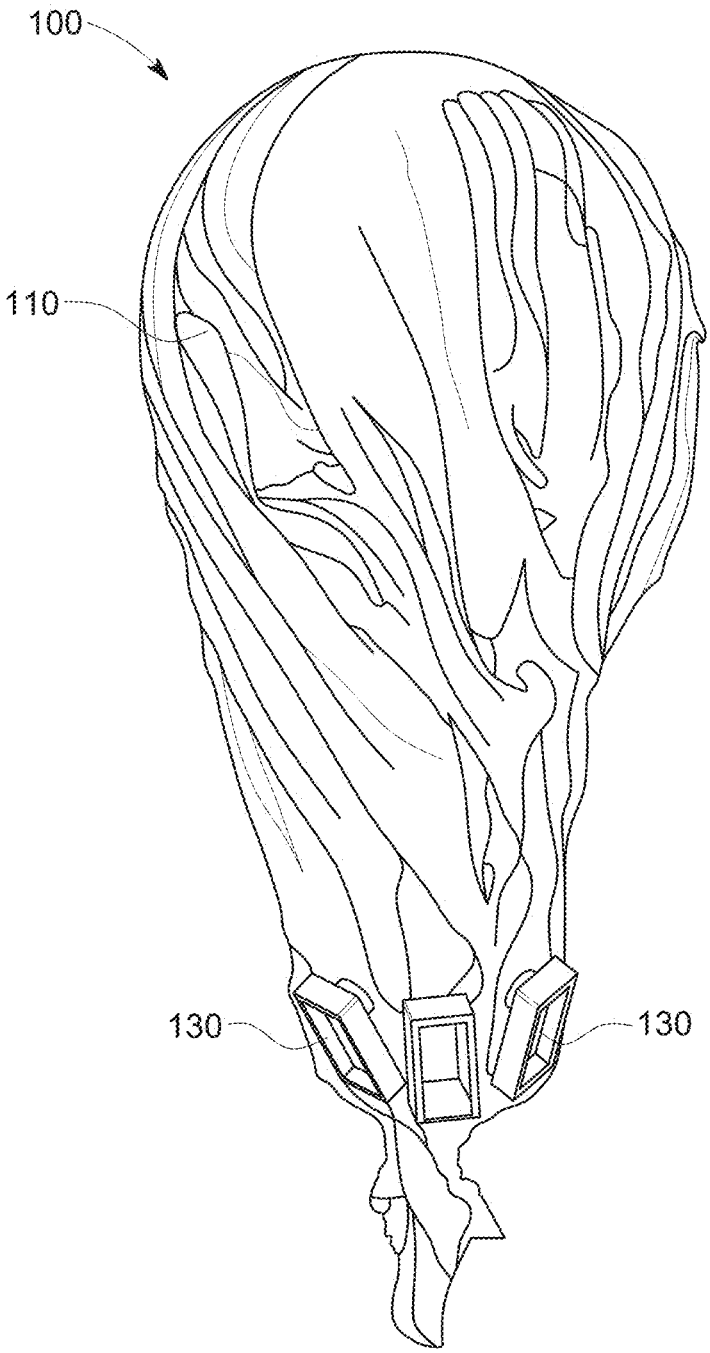
FIG. 5 is a schematic view illustrating subsequent movement of the blast shield apparatus to contain detonation debris of the explosion.

FIG. 5 is a schematic view illustrating subsequent movement of the blast shield apparatus 100 to contain detonation debris of the explosion. When the detonation occurs, the explosion ruptures the air bladder 120, forces the blanket 110 upward (toward the surface) in a shape similar to a balloon, and as the blanket 110 rises in the center, the blanket magnets 130 near the edge come close enough for the magnets 130 to attach to one another and seal the explosion and byproducts within the blanket 110.

After the explosion completes, the blanket 110 and enclosed ordnance remnants sink to the seafloor/bottom and can be retrieved via a magnet lowered by a cable from the surface. The electromagnets 130 are powerful enough to stay attached to one another until they are turned off post-retrieval. The explosion reaction (e.g., repeated bubble formation and cavitation) remains contained within the enclosed blanket 110. The explosion reaction eventually ceases, and the weight of the blanket 110 and magnets 130 cause the blast shield apparatus 100 to sink to the bottom of the waterbody. The apparatus 100 and enclosed ordnance remnants can then be retrieved using a retrieval magnet (e.g., another electromagnet) that is lowered by a cable from the surface. Thus, the force and byproducts of the explosion are contained throughout the process, minimizing potential hazards from shock waves, shrapnel, and chemical releases.

Figure 6:
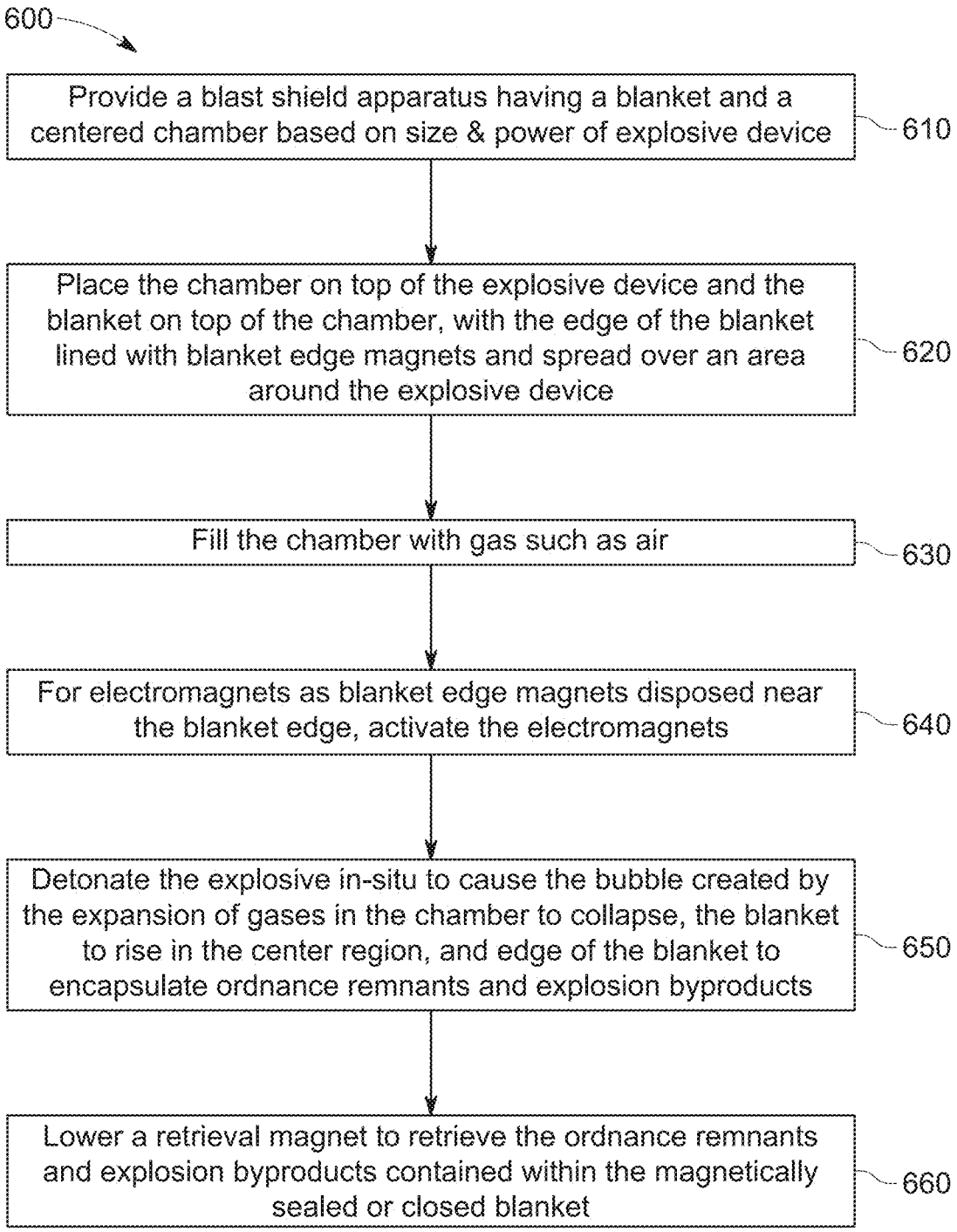
FIG. 6 is a flow diagram illustrating a blast shield method according to an embodiment.

FIG. 6 is a flow diagram 600 illustrating a blast shield method according to an embodiment. Step 610 involves, based on the size and/or explosive power of the explosive device, provide a blast shield apparatus 100 including a blast shield blanket 110 and a self-sacrificing chamber 120 which is disposed in a center region of the blanket and has a distressed or pre-ripped/punctured bottom surface. In step 620, the chamber 120 is placed on top of the explosive device and the blanket 110 is disposed on top of the chamber 120. The edge of the blanket 110 is lined with edge magnets and is spread over an area around the explosive device. Step 630 involves filling the chamber 120 with gas such as air. In step 640, for a blanket 110 lined with electromagnets 130 near the blanket edge(s), the electromagnets are turned on (from a deactivated state to an activated state). Step 650 involves detonating the explosive in-situ, preferably within seconds or fraction of a second or almost immediately, after the electromagnets are activated, and causing the chamber 120 to break and allow the explosive reaction access to the encapsulated air, the bubble created by the explosion reaction to expand and collapse repeatedly within the confines of the blanket 110, the blanket 110 to rise in the blanket center region, and the edge(s) of the blanket 110 to encapsulate the ordnance remnants and explosion byproducts. In step 660, a magnet is lowered from a surface vessel to retrieve the ordnance remnants and explosion byproducts because all ordnance remnants have been contained within the magnetically sealed or closed blanket.

Embodiments of the invention can be manifest in the form of methods and apparatuses for practicing those methods. As compared to prior approaches, this blast shield apparatus and method have a number of distinguishing features. For instance, the blast shield technique is used to mitigate effects of intentional detonation of the UXO, as opposed to other approaches that seek to prevent the explosion from happening. The present technique uses a unique, self-sacrificing air bladder that absorbs a significant amount of the shock from the initial explosion and the subsequent bubble formation and cavitation. It uses electromagnets to facilitate closing of the blanket around the detonation and fully encapsulating the post-explosion shrapnel/constituents. After the explosion, the blast shield apparatus is easily retrievable, for example, by lowering a magnet from a surface vessel. The blast shield blanket lined with magnets facilitates easy collection/disposal of the explosion byproducts because all ordnance remnants have been contained within the magnetically sealed blanket. The blast shield apparatus is easily adaptable to various shapes and sizes to accommodate various UXO dimensions and explosive powers. The present technique provides a safer alternative to other UXO neutralization/remediation techniques, including decreased risks to diver safety, infrastructure (near-onshore, above-water, floating, underwater, and buried sub-sediment), underwater historical artifacts, and the proximal marine ecosystem (biotic and abiotic) that are affected by the blast pressure waves and acoustics.

As will be appreciated by one of ordinary skill in the art, the present invention may be embodied as an apparatus (including, for example, a system, a machine, a device, and/or the like), as a method (including, for example, a business process, and/or the like), as a computer-readable storage medium, or as any combination of the foregoing.

The inventive concepts taught by way of the examples discussed above are amenable to modification, rearrangement, and embodiment in several ways. Accordingly, although the present disclosure has been described with reference to specific embodiments and examples, persons skilled in the art will recognize that changes may be made in form and detail without departing from the spirit and scope of the disclosure.

An interpretation under 35 U.S. C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features and/or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not to be taken as limiting or restricting the systems, techniques, approaches, methods, devices to those appearing in any section. Rather, the teachings and disclosures herein can be combined, rearranged, with other portions of this disclosure and the knowledge of one of ordinary skill in the art. It is the intention of this disclosure to encompass and include such variation.

The indication of any elements or steps as "optional" does not indicate that all other or any other elements or steps are mandatory. The claims define the invention and form part of the specification. Limitations from the written description are not to be read into the claims.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A blast shield apparatus comprising:

a blast resistant blanket having a blanket edge and a blanket center region;

a plurality of blanket magnets disposed near the blanket edge and distributed along the blanket edge; and a chamber having a first side facing the blast resistant blanket and coupled to the blanket center region of the blast resistant blanket, and a second side opposite from the first side and facing away from the blast resistant blanket;

the chamber including a chamber interior to store a gas.

2. The blast shield apparatus of claim 1, wherein the blanket magnets are substantially evenly distributed along the blanket edge.

3. The blast shield apparatus of claim 1, wherein the blanket magnets comprise electromagnetics switchable between an activated state and a deactivated state.

4. The blast shield apparatus of claim 1, wherein the second side of the chamber has a pre-ripped surface.

5. The blast shield apparatus of claim 4, wherein the pre-ripped surface includes a plurality of slits including at least of one or more through slits through a thickness of the second side of the chamber or one or more partially through slits on the pre-ripped surface.

6. The blast shield apparatus of claim 1, wherein the second side of the chamber has a second side surface area larger than a surface area of an explosive device, the surface area of the explosive device being an upper surface area of an upper surface of the explosive device or an exposed surface area of an exposed surface of the explosive device.

7. The blast shield apparatus of claim 1, wherein the blast resistant blanket has a top side and a bottom side each having a surface area which is one to three orders of magnitude larger than a surface area of an explosive device, the surface area of the explosive device being an upper surface area of an upper surface of the explosive device or an exposed surface area of an exposed surface of the explosive device.

8. The blast shield apparatus of claim 1, wherein the blast resistant blanket has a top side and a bottom side each having a surface area which is one to two orders of magnitude larger than a first side surface area of the first side of the chamber.

9. The blast shield apparatus of claim 1, wherein the first side of the chamber is attached to the blanket center region of the blast resistant blanket.

10. The blast shield apparatus of claim 1, wherein the chamber includes a gas inlet to receive a flow of gas into the chamber interior of the chamber.

11. A blast shield method comprising:

placing a blast shield apparatus on top of an explosive device, the blast shield apparatus including a blast resistant blanket having a blanket edge and a blanket center region, a plurality of blanket magnets disposed near the blanket edge and distributed along the blanket edge, and a chamber having a first side facing the blast resistant blanket and coupled to the blanket center region of the blast resistant blanket, and a second side opposite from the first side and facing away from the blast resistant blanket and toward the explosive device, the second side disposed on top of the explosive device;

filling the chamber with a gas; and detonating the explosive device.

12. The blast shield method of claim 11, further comprising, after detonating the explosive device to cause a bubble created by an expansion of the gas in the chamber to collapse, the blast resistant blanket to rise in the blanket center region, and the blanket edge of the blast resistant blanket to encapsulate debris and byproducts of the detonated explosive device:

lowering a retrieval magnet to contact the blanket magnets to retrieve the debris and byproducts of the detonated explosive device encapsulated by the blast resistant blanket closed by the blanket magnets coming in contact with each other.

13. The blast shield method of claim 11, further comprising distributing the blanket magnets substantially evenly along the blanket edge and spreading the blanket magnets over an area around the explosive device.

14. The blast shield method of claim 11, wherein the blanket magnets are electromagnets, the method further comprising, prior to detonating the explosive device:

switching the electromagnetics from an inactivated state to an activated state.

15. The blast shield method of claim 11, further comprising:

pre-ripping the second side of the chamber to produce a pre-ripped surface facing the explosive device before placing the blast shield apparatus on top of the explosive device.

16. The blast shield method of claim 11, wherein the second side of the chamber has a second side surface area larger than a surface area of the explosive device, the surface area of the explosive device being an upper surface area of an upper surface of the explosive device or an exposed surface area of an exposed surface of the explosive device.

17. The blast shield method of claim 11, wherein the blast resistant blanket has a top side and a bottom side each having a surface area which is one to three orders of magnitude larger than a surface area of the explosive device, the surface area of the explosive device being an upper surface area of an upper surface of the explosive device or an exposed surface area of an exposed surface of the explosive device.

18. The blast shield method of claim 11, wherein the blast resistant blanket has a top side and a bottom side each having a surface area which is one to two orders of magnitude larger than a first side surface area of the first side of the chamber.

19. The blast shield method of claim 11, further comprising:

attaching the first side of the chamber to the blanket center region of the blast resistant blanket.

20. A blast shield apparatus comprising:

a blast resistant blanket having a blanket edge and a blanket center region;

a plurality of blanket magnets disposed near the blanket edge and distributed along the blanket edge;

a chamber having a first side facing the blast resistant blanket and coupled to the blanket center region of the blast resistant blanket, and a second side opposite from the first side and facing away from the blast resistant blanket, the chamber including a chamber interior to store a gas; and means for, after an explosion causes a bubble created by an expansion of the gas in the chamber to collapse and the blast resistant blanket to rise in the blanket center region relative to the blanket edge, to close the blast resistant blanket at the blanket edge to encapsulate explosion debris and byproducts of the explosion.

* * * * *